US009211469B2

(12) United States Patent
Lane

(10) Patent No.: US 9,211,469 B2
(45) Date of Patent: Dec. 15, 2015

(54) ICE SKATEBOARD AND CONVERSION KIT

(71) Applicant: John W. Lane, Palmdale, CA (US)

(72) Inventor: John W. Lane, Palmdale, CA (US)

( * ) Notice: Subject to any disclaimer, the term of this patent is extended or adjusted under 35 U.S.C. 154(b) by 0 days.

(21) Appl. No.: 14/588,880

(22) Filed: Jan. 2, 2015

(65) Prior Publication Data

US 2015/0182848 A1 Jul. 2, 2015

Related U.S. Application Data

(60) Provisional application No. 61/922,952, filed on Jan. 2, 2014.

(51) Int. Cl.
*B62M 1/00* (2010.01)
*A63C 17/01* (2006.01)

(52) U.S. Cl.
CPC ..... *A63C 17/018* (2013.01); *A63C 17/017* (2013.01)

(58) Field of Classification Search
CPC ..... A63C 17/017; A63C 17/018; A63C 17/18
USPC ..... 280/87.042, 7.13, 14.26; 301/5.305, 301/5.306
See application file for complete search history.

(56) References Cited

U.S. PATENT DOCUMENTS

| | | | | |
|---|---|---|---|---|
| 2,697,010 | A | 12/1954 | Hirschmugl | |
| 3,329,439 | A | 7/1967 | Gebien | |
| 3,400,988 | A | 9/1968 | Hudson et al. | |
| 4,114,913 | A | 9/1978 | Newell et al. | |
| 4,116,455 | A | 9/1978 | Dotson et al. | |
| 4,194,753 | A | 3/1980 | Schrishuhn, Jr. | |
| 4,225,145 | A | 9/1980 | Carr | |
| D261,168 | S | 10/1981 | Rice, Jr. | |
| 4,521,029 | A * | 6/1985 | Mayes | 280/7.14 |
| 4,896,893 | A * | 1/1990 | Shumays et al. | 280/14.21 |
| 5,161,810 | A | 11/1992 | DeCesare | |
| 5,259,632 | A | 11/1993 | Mahoney | |
| 5,356,209 | A | 10/1994 | Hill | |
| 5,374,072 | A | 12/1994 | Landers | |
| D364,127 | S | 11/1995 | Scherr et al. | |
| 6,311,990 | B1 * | 11/2001 | Landry | 280/14.26 |
| 6,619,674 | B2 | 9/2003 | Baldwin | |
| 7,699,323 | B2 | 4/2010 | Taylor | |
| 2004/0251650 | A1 * | 12/2004 | Katsuyama et al. | 280/87.042 |
| 2005/0212226 | A1 | 9/2005 | Landry | |
| 2012/0146300 | A1 | 6/2012 | Giannatos | |

FOREIGN PATENT DOCUMENTS

| | | |
|---|---|---|
| CA | 2313723 | 9/2001 |
| EP | 0826398 | 3/1998 |
| GB | 453425 | 9/1936 |
| WO | 9503861 | 2/1995 |
| WO | 9626775 | 9/1996 |

* cited by examiner

*Primary Examiner* — Hau Phan
*Assistant Examiner* — Bryan Evans
(74) *Attorney, Agent, or Firm* — Kunzler Law Group, PC

(57) ABSTRACT

Ice skateboards, ice skateboard conversion kits, and methods for converting a skateboard to an ice skateboard are presented. An ice skateboard or an ice skateboard conversion kit may include four blades. Each blade may include an elongate sharp lower edge and an opening for pivotally mounting the blade on one of four skateboard axle ends. Eight spacer bushings each may include a bore for pivotally mounting the spacer bushing on one of the axle ends. Lengths of two of the spacer bushings may be configured to dispose at least one of the blades along a middle third of one of the axle ends when the blade is pivotally mounted to the axle end between the two spacer bushings.

19 Claims, 4 Drawing Sheets

ICE SKATEBOARD AND CONVERSION KIT

CROSS-REFERENCE TO RELATED APPLICATION

This application claims the benefit of U.S. Provisional Patent Application No. 61/922,952, filed on Jan. 2, 2014, which is incorporated herein by reference.

FIELD

This disclosure relates to skateboards, and more particularly relates to configuring skateboards for use on ice.

BACKGROUND

When using a wheeled skateboard, a skater rides atop a deck that has four wheels mounted underneath. The wheels are mounted transversely on two trucks, which are positioned underneath front and rear portions of the deck. Wheeled skateboards perform well on high-friction surfaces, such as concrete, asphalt, and wood, but perform poorly on low-friction surfaces, such as ice.

Ice skateboards use blades instead of wheels. Some ice skateboards use blades attached to conventional skateboard trucks, and others use blades mounted in another way

SUMMARY

The subject matter of the present application has been developed in response to the present state of the art, and in particular, in response to the problems and needs associated with skateboarding on ice that have not yet been fully solved by currently available ice skateboards. Accordingly, the subject matter of the present application has been developed to provide an ice skateboard and an ice skateboard conversion kit that overcome many of the shortcomings of the prior art.

An ice skateboard conversion kit is presented. In one embodiment, the ice skateboard conversion kit includes four blades. Each blade includes an elongate sharp lower edge and an opening for pivotally mounting the blade on one of four skateboard axle ends. The ice skateboard conversion kit includes eight spacer bushings. Each spacer bushing may include a bore for pivotally mounting the spacer bushing on one of the axle ends. Lengths of two of the spacer bushings may be configured to dispose at least one of the blades along a middle third of one of the axle ends when the blade is pivotally mounted to the axle end between the two spacer bushings.

In certain implementations of the kit, at least one of the spacer bushings includes a recess configured to receive a bearing so that a bore for the bearing aligns with the bore for the at least one spacer bushing. The bore for the bearing may be sized to receive one of the axle ends. In a further implementation, the bore for a spacer bushing may be larger than the bore for a bearing. In some implementations, at least one of the spacer bushings may include a blade engagement member shaped to engage the opening for at least one of the blades. In one implementation, the blade engagement member and the opening may be circular. In another implementation, the blade engagement member and the opening may include corresponding, non-circular, shapes.

According to other implementations of the kit, at least one of the blades may include a flat metal body. In a further implementation, the flat metal body may include the elongate sharp lower edge and the opening for mounting the blade. In a certain implementation, the elongate sharp lower edge for each of the four blades may include a symmetrical, V-shaped cross-section. The symmetrical, V-shaped cross-section may have an included angle of approximately 60 degrees. In some implementations, at least one of the blades may have a height to length ratio of approximately 0.32. In certain implementations, at least one of the blades may have a length L of approximately 5 inches. In one implementation, a center of gravity for at least one of the blades may be disposed directly below a center of the opening for the blade when the elongate sharp lower edge for the blade is in a horizontal position. In a further implementation, the elongate sharp lower edge for at least one of the blades may include an upward-sloped toe portion or an upward-sloped heel portion.

An ice skateboard also is presented. In one embodiment, the ice skateboard includes a skateboard deck. A pair of skateboard trucks may be coupled to the skateboard deck. Each truck may include two axle ends. The ice skateboard may include four blades. Each blade may include a flat metal body. The flat metal body of each blade may include an elongate sharp lower edge and an opening by which the blade is pivotally mounted to one of the axle ends. Each elongate sharp lower edge may include a symmetrical, V-shaped cross-section.

In one implementation of the ice skateboard, at least one of the blades may be positioned along a middle third of one of the axle ends. In a certain implementation, at least one of the blades may be mounted directly to one of the axle ends without a blade housing. In some implementations, the symmetrical, V-shaped cross-section for the blades may have an included angle of approximately 60 degrees. In certain implementations, at least one of the blades may have a height to length ratio of approximately 0.32. In one implementation, at least one of the blades may have a length of approximately 5 inches.

A method is presented for converting a skateboard to an ice skateboard. In one embodiment of the method, the skateboard includes wheels are mounted to axle ends. The method includes removing the wheels from each axle end. Also, the method includes mounting a first bearing, a first spacer bushing, a blade, a second spacer bushing, and a second bearing on each axle end, so that the first bearing is disposed within the first spacer bushing, the second bearing is disposed within the second spacer bushing, and the blade is disposed between the first spacer bushing and the second spacer bushing.

The described features, structures, advantages, and/or characteristics of the subject matter of the present disclosure may be combined in any suitable manner in one or more embodiments and/or implementations. In the following description, numerous specific details are provided to impart a thorough understanding of embodiments of the subject matter of the present disclosure. One skilled in the relevant art will recognize that the subject matter of the present disclosure may be practiced without one or more of the specific features, details, components, materials, and/or methods of a particular embodiment or implementation. In other instances, additional features and advantages may be recognized in certain embodiments and/or implementations that may not be present in all embodiments or implementations. Further, in some instances, well-known structures, materials, or operations are not shown or described in detail to avoid obscuring aspects of the subject matter of the present disclosure. The features and advantages of the subject matter of the present disclosure will become more fully apparent from the following description and appended claims, or may be learned by the practice of the subject matter as set forth hereinafter.

BRIEF DESCRIPTION OF THE DRAWINGS

In order that the advantages of the subject matter may be more readily understood, a more particular description of the subject matter briefly described above will be rendered by reference to specific embodiments that are illustrated in the appended drawings. Understanding that these drawings depict only typical embodiments of the subject matter and are not therefore to be considered to be limiting of its scope, the subject matter will be described and explained with additional specificity and detail through the use of the drawings, in which.

DETAILED DESCRIPTION

In various embodiments, the ice skateboard disclosed herein includes blades instead of wheels, for skateboarding on ice. In further embodiments, a corresponding conversion kit allows a skater to convert a wheeled skateboard to an ice skateboard, by replacing the wheels with blades. Applicants recognize that an ice skateboard that is both stable and maneuverable can facilitate skateboarding tricks. Also, it is useful to prevent outer portions of the blades from digging into the ice by allowing the blades to pivot relative to the deck of the skateboard, so that they stay parallel to the surface of the ice as the ice skateboard changes positions.

Figure 1:
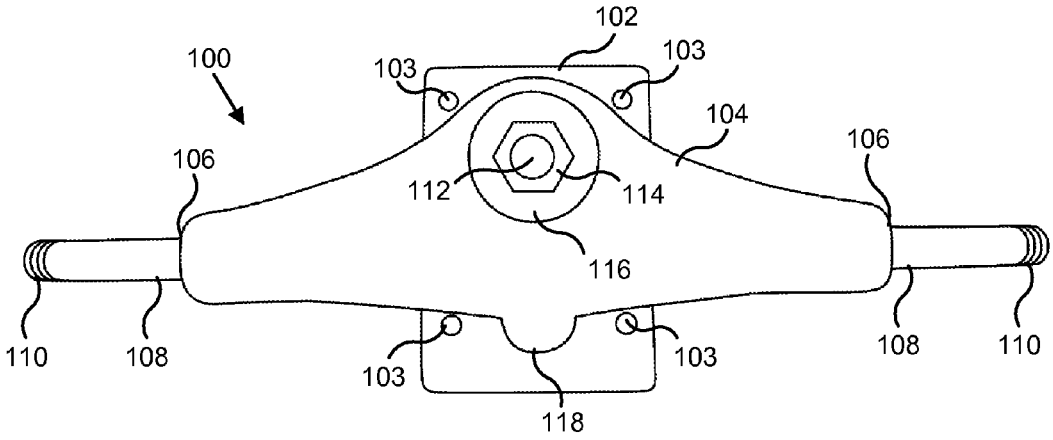
FIG. 1 is a view illustrating one embodiment of a conventional skateboard truck, as viewed from beneath a skateboard.

FIG. 1 depicts one embodiment of a conventional skateboard truck 100, as viewed from underneath a skateboard deck. Although not shown, the skateboard deck is configured for a rider to stand on. Two trucks 100 may be mounted underneath front and rear portions of the deck. Although only one truck 100 is shown in FIG. 1, various embodiments of ice skateboards may include a pair of skateboard trucks 100 coupled to the skateboard deck. Similarly, in one embodiment, a conventional wheeled skateboard may already include a skateboard deck and a pair of trucks 100 with wheels, and an ice skateboard conversion kit may include additional parts used to convert the wheeled skateboard to an ice skateboard using the existing trucks 100. Although an ice skateboard and an ice skateboard conversion kit may differ according to whether the skateboard deck and trucks 100 are provided along with ice skateboard blades or provided by the user, other components described herein as part of an ice skateboard may also be included in an ice skateboard conversion kit, and vice versa.

In the depicted embodiment, the truck 100 includes a base plate 102, a hanger 104, and an axle 106. The base plate 102 has a generally flat upper surface, and mounting holes 103 that extend through the base plate 102 for attaching the base plate 102 to the underside of the skateboard deck in a fixed position relative to the skateboard deck using screws or similar fasteners.

As used herein, directional words like "underneath," "above," "top," "bottom," "horizontal," "vertical," "left," "right," "side," and the like refer to a skateboard in the typical position for skating. Therefore, the deck of a skateboard is above the trucks 100, and the nose of the skateboard is towards the front. As used herein, "outboard" refers to a direction away from a longitudinal center line of the skateboard, and "inboard" refers to the opposite direction, towards the center line. These terms are used, where applicable, to provide some clarity of description when dealing with relative relationships. But, these terms are not intended to imply absolute relationships, positions, and/or orientations. For example, with respect to an object, an "upper" surface can become a "lower" surface simply by turning the object over. Nevertheless, it is still the same object.

In one embodiment, the hanger 104 encloses a central portion of the axle 106, leaving two skateboard axle ends 108 exposed where wheels or blades may be mounted. As used herein, the term "axle end" 108 refers to the entire end portion of an axle 106 that extends beyond the hanger 104, not just to the endmost face of the axle 106. In a certain embodiment, the hanger 104 couples the axle 106 to the base plate 102, holding the axle 106 in a substantially transverse position relative to the skateboard deck. Thus, in one embodiment, a wheeled skateboard may include four wheels mounted transversely on opposite axle ends 108 of two trucks 100, underneath front and rear portions of the deck. Similarly, in a certain embodiment, an ice skateboard may include four blades mounted transversely on opposite axle ends 108 of two trucks 100, underneath front and rear portions of the deck.

In one embodiment, the hanger 104 is secured to the base plate 102 via a kingpin bolt 112. The kingpin bolt 112 extends from the base plate 102 through an opening in the hanger 104. In further embodiments, compressible bushings (not shown) are also mounted to the kingpin bolt 112 above and below the hanger 104, and curved washers 116 hold the compressible bushings in position. A skater may steer a wheeled skateboard or ice skateboard by leaning to one side of the skateboard, which compresses the compressible bushings more on one side than on the other, so that the hanger 104 pivots with relation to a pivot cup 118 in the base plate 102.

A nut 114 at the end of the kingpin bolt 112 secures the hanger 104, compressible bushings, and curved washers 116 in place, and may be tightened or loosened to adjust the stiffness of the compressible bushings. The nut 114 may be a locking nut, such as a nylon insert lock nut or the like, which resists loosening while the skateboard is in use.

In one embodiment, the axle 106 may be a single piece. In another embodiment, the axle 106 may be formed from multiple pieces, such as two collinear half-axles fitted into opposite sides of the hanger 104. For wheeled skateboards, each wheel is pivotally connected to an axle end 108 via bearings, allowing the wheels to rotate with minimal frictional resistance. In various embodiments of the ice skateboard disclosed herein, each blade is similarly pivotally connected to an axle end 108. Although ice skateboard blades may not turn like wheels during the forward motion of the skateboard in some embodiments, connecting the blades to the axle ends 108 allows a user to easily exchange wheels and blades on a skateboard. Furthermore, in certain embodiments, pivotally connecting blades to the axle ends 108 may allow the blades to stay parallel to the surface of the ice as the ice skateboard changes positions, thus preventing end portions of the blades from digging into the ice.

In the depicted embodiment, a threaded portion 110 of the axle end 108 extends beyond where a wheel or blade would be mounted to the axle end 108, and a nut (not shown) may engage with the threaded portion 110, to secure the wheel or blade in place on the axle end 108 between the hanger 104 and the threaded portion 110. Like the kingpin nut 114, a nut that engages the threaded portion 110 of an axle end 108 may, in some embodiments, be a locking nut, such as a nylon insert lock nut or the like, which resists loosening while the skateboard is in use.

Figure 2:
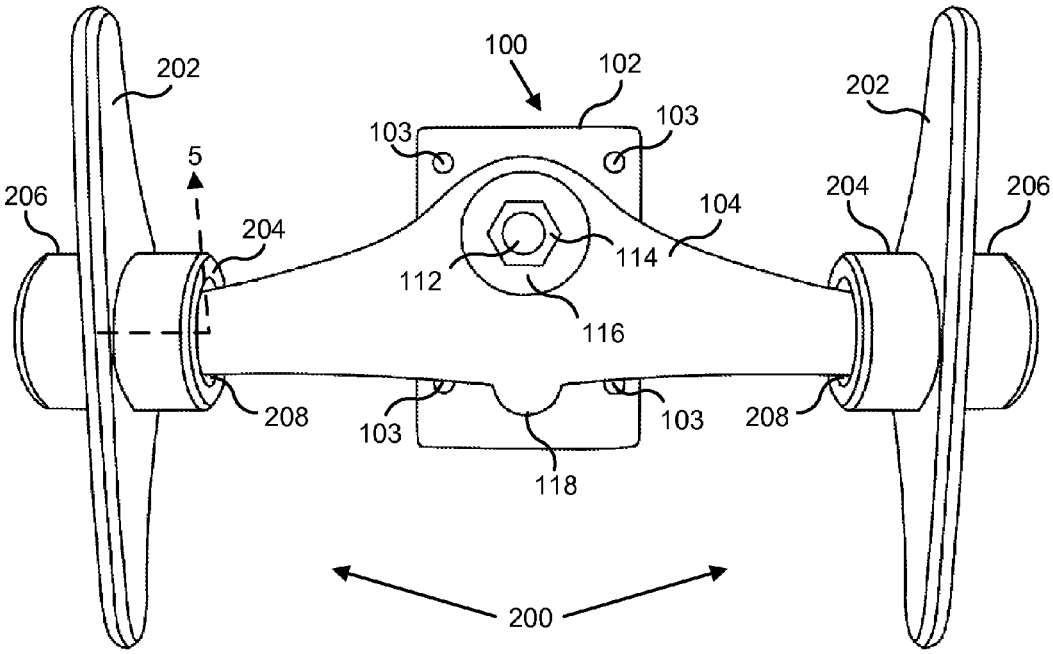
FIG. 2 is a perspective view illustrating one embodiment of an ice skateboard conversion kit mounted to the skateboard truck of FIG. 1.

FIG. 2 depicts one embodiment of an ice skateboard conversion kit 200, mounted to the embodiment of a skateboard truck 100 depicted in FIG. 1. As in FIG. 1, the truck 100 and the ice skateboard conversion kit 200 in FIG. 2 are depicted as viewed from underneath a skateboard deck. The ice skateboard conversion kit 200 includes blades 202 and spacer bushings 204, 206. It is recognized that only partial embodiments of an ice skateboard conversion kit 200 are shown. In full embodiments of an ice skateboard conversion kit, similar components are mounted on all four axle ends, on both trucks of a skateboard. To avoid duplication, however, only the components mounted on one truck 100 are shown and described. Thus, although two blades 202 and four spacer bushings 204, 206 are shown, an ice skateboard conversion kit 200, in certain embodiments, may include four blades 202 and eight spacer bushings 204, 206.

In general, in certain embodiments, each blade 202 includes an elongate sharp lower edge for skating on ice. In one embodiment, the blades 202 and spacer bushings 204, 206, are all configured to be pivotally mounted to an axle end 108 of a truck 100. In a certain embodiment, pivotal motion of the blades 202 about the axle ends 108 may allow a skater to skate smoothly over irregular surfaces. In a further embodiment, pivotal motion of the blades 202 may also allow the blades 202 to stay parallel to the surface of the ice as they disengage and reengage the ice during skateboarding tricks, thus preventing the blades 202 from digging into the ice. The blade 202 is described in further detail below with regard to FIGS. 3 and 4.

In one embodiment, a blade 202 is pivotally mounted to the axle end 108 between two opposing spacer bushings 204, 206, so that a first spacer bushing 204 is mounted inboard of the blade 202, and a second spacer bushing 206 is mounted outboard of the blade 202. In some embodiments, this opposing configuration of spacer bushings 204, 206 maintains the distance of the blade 202 from the hanger 104 and from the threaded portion 110 of the axle end 108. In further embodiments, the opposed spacer bushings 204, 206 may also hold the blade 202 in a vertical position, thus preventing the blade 202 from tilting or wobbling while the skateboard is in use. In addition to maintaining the blade's 202 position along the axle end 108, and preventing the blade 202 from tilting or wobbling, the spacer bushings 204, 206 may, in some embodiments, engage an opening in the blade 202 to support the blade 202, so that the blade 202 does not directly engage the axle end 108. Each spacer bushing 204, 206 may in turn be supported by a bearing as described below. Thus, in general, the axle end 108 may support bearings, which support spacer bushings 204, 206, which support the blade 202, so that the bearings allow the spacer bushings 204, 206 and the blade 202 to pivot freely about the axle end 108

In one embodiment, the spacer bushings 204, 206 are also pivotally mounted to the axle end 108. Pivotally mounting the spacer bushings 204, 206 to the axle end 108 may allow the spacer bushings 204, 206 and the blade 202 to rotate together, so that friction from the opposing spacer bushings 204, 206 does not hinder the pivotal motion of the blade 202 about the axle end 108, because the blade 202 and the spacer bushings 204, 206 co-rotate. In another embodiment, however, the spacer bushings 204, 206 may maintain the position of the blade 202 along the axle end 108 without pivoting about the axle end 108, and the blade 202 may still be allowed to pivot about the axle end 108 by reducing the friction between the blade 202 and the opposing spacer bushings 204, 206. In various embodiments, friction between the blade 202 and the spacer bushings 204, 206 may be reduced by reducing the diameter of the spacer bushings 204, 206, lubricating the space between the blade 202 and the spacer bushings 204, 206, making the spacer bushings 204, 206 out of low-friction material, or the like.

In one embodiment, the lengths of the first spacer bushing 204 and the second spacer bushing 206 are configured to dispose or position the blade 202 along a middle third of the axle end 108. As used herein, the length of a spacer bushing 204, 206 refers to the distance between faces of the spacer bushing 204, 206, along a line parallel to the axis of the spacer bushing 204, 206. For example, the first spacer bushing 204 and the second spacer bushing 206 can have an approximately equal length so that the blade 202 is positioned approximately halfway between the end of the hanger 104 and the threaded portion 110 of the axle end 108. (As used herein, a measurement is "approximately" equal to a stated value if it is within 10% of the stated value). In a certain embodiment, positioning all four ice skateboard blades 202 near the middle of each axle end 108 provides stability similar to a wheeled skateboard, as well as maneuvering flexibility.

In another embodiment, the first spacer bushing 204 and the second spacer bushing 206 are of differing lengths, in order to position a blade 202 closer to or further from the hanger 104. In one embodiment, positioning blades 202 closer to the hanger 104 provides additional maneuvering flexibility at the expense of stability. In a further embodiment, to provide still further maneuvering flexibility, the blades 202 may be positioned adjacent to the hanger 104 by omitting the inboard spacer bushing 204 and using a longer outboard spacer bushing 206. Conversely, in another embodiment, positioning blades 202 further from the hanger 104 provides additional stability at the expense of maneuvering flexibility. In a further embodiment, to provide still further stability, the blades 202 may positioned adjacent to the threaded portion 110 of the axle end 108 by omitting the outboard spacer bushing 206 and using a longer inboard spacer bushing 204. However, in some embodiments, omitting one of the spacer bushings 204, 206 may cause friction between the blade 202 and the hanger 104 or the axle nut, interfering with ability of the blade 202 to pivot about the axle end 108.

In one embodiment, all four blades 202 are positioned approximately the same distance from the hanger 104. In another embodiment, however, the blades 202 may be positioned at varying distances from the hanger 104. For example, in one embodiment, blades 202 in front of the skateboard may be closer to each other, or further apart, than blades 202 in back of the skateboard, and the lengths of the spacer bushings 204, 206 may vary accordingly. In light of this disclosure, many configurations of the positions of the blades 202 are clear and may be achieved with various lengths of spacer bushings 204, 206, in various embodiments, and that have varying stability and maneuvering flexibility characteristics.

In one embodiment, an ice skateboard may include two standard skateboard trucks 100, used with four blades 202 and eight spacer bearings 204, 206 as shown with regard to the ice skateboard conversion kit 200 of FIG. 2. In another embodiment, however, an ice skateboard may include modified trucks 100 that include a wider hanger 104 and/or shorter axle ends 108, which may hold a blade 202 in position between the hanger 104 and the axle nut like a skateboard wheel, without the use of spacer bushings 204, 206, with only an inboard spacer bushing 204, or with only an outboard spacer bushing 206.

In one embodiment, one or more of the spacer bushings 204, 206 includes a recess, or cavity, 208 configured to receive a bearing. A bearing may be disposed in the recess 208, so that the spacer bushing 204, 206, including the recess 208, is mounted to the axle end 108 over a bearing. Disposing a bearing within a recess 208 in a spacer bushing 204, 206 allows the spacer bushing 204, 206 to pivot with little frictional resistance, thus also facilitating the pivoting of nearby components, such as the blade 202 and/or another, opposing spacer bushing 204, 206. Pivoting with little frictional resistance gives the blades 202 a fluid motion when returning to a natural position for the skateboard to land in (e.g., after performing an aerial maneuver) and maintains the blades 202 parallel to the surface of the ice so that the outer edges of the blades 202 do not slow the skater by digging in and gouging the ice.

The recess 208 is only visible in FIG. 2 for the inboard spacer bushings 204 due to perspective. Nevertheless, in one embodiment, all the inboard and outboard spacer bushings 204, 206 may include a similar recess 208 for a bearing, so that the bearings in each spacer bushing 204, 206 facilitate fluid motion of all the spacer bushings 204, 206 and blades 202. In another embodiment, however, some, or none of the spacer bushings 204, 206 may include a recess 208 for a bearing. A spacer bushing including a recess 208 for a bearing is described in further detail below with regard to FIG. 5.

In one embodiment, a bearing for the spacer bushing 204, 206 may include balls which roll between an inner race and an outer race. In a further embodiment, one or more shields on either side of the bearing, extending between the inner race and the outer race, may protect the balls from undesirable elements such as dust, grit, and the like. The inner race may surround a bore sized to receive an axle end 108, and the recess 208 in the spacer bushing 204, 206 may be sized to receive the outer race.

In one embodiment, as bearings are readily available for use with skateboard wheels in a standard "608" size, with a bore of 8 mm, an outer diameter of 22 mm, and a width of 7 mm, a spacer bushing 204, 206 may be configured to receive a standard skateboard wheel bearing. However, it is clear in light of this disclosure that in various embodiments, different sizes of recesses 208 in spacer bushings 204, 206 may accommodate different sizes of bearings. In a certain embodiment, an ice skateboard conversion kit 200 may include bearings for each recess 208. For example, in one embodiment, an ice skateboard conversion kit 200 may include eight spacer bushings 204, 206 with recesses 208 for bearings, and may also include eight corresponding bearings. In another embodiment, however, an ice skateboard conversion kit 200 may include spacer bushings 204, 206 with recesses 208 for standard skateboard wheel bearings, but may not include the bearings; instead, a skater may reuse his or her wheel bearings, or obtain new wheel bearings for use with the ice skateboard.

Figure 3:
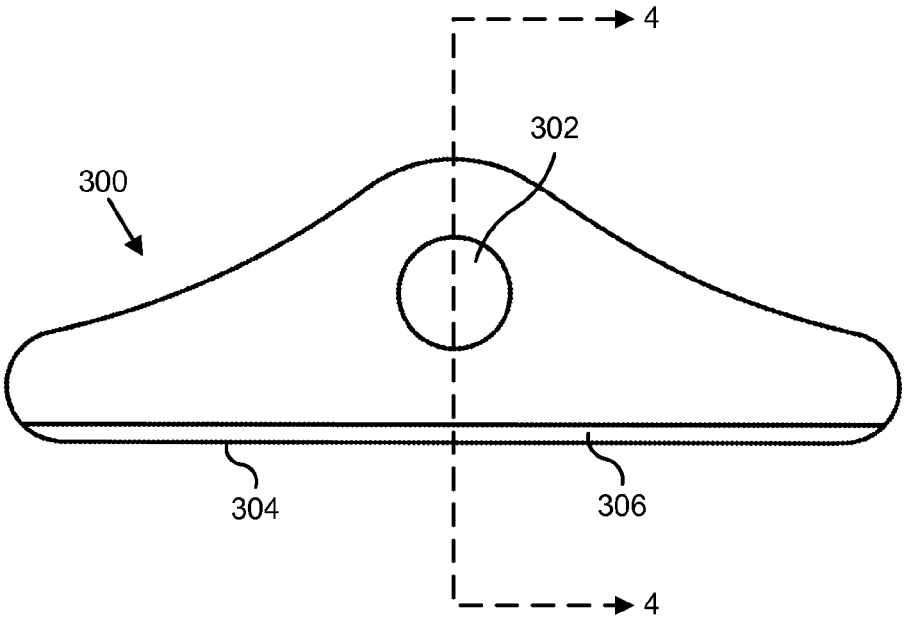
FIG. 3 is a side view illustrating one embodiment of a blade for an ice skateboard.
Figure 4:
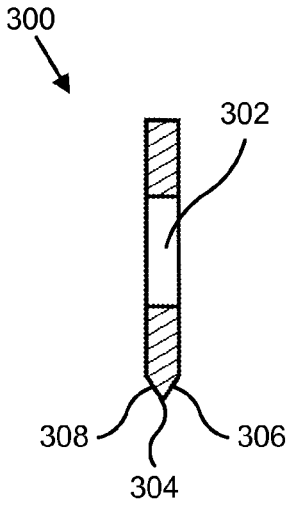
FIG. 4 is a cross-sectional view illustrating the blade of FIG. 3, in a further embodiment.

FIGS. 3 and 4 depict one embodiment of a blade 300 for an ice skateboard. FIG. 3 presents a side view of the blade 300, and FIG. 4 presents a cross-sectional view of the blade 300, from the location and in the direction indicated by the broken line in FIG. 3. The blade 300 may be configured substantially as described above with regard to the blade 202 of FIG. 2.

In the depicted embodiment, the blade 300 consists of a flat body. In general, a flat body for a blade 300 may be a plate-like element comprising a first side surface parallel to a second side surface, with a thickness between the first and second side surfaces significantly smaller than a height or length of the side surfaces. In another embodiment, however, the blade 300 may include additional components, but still have a flat body. For example, in one embodiment, the blade 300 may include a bumper or cushion on an upper portion of the blade, to prevent a pivoting blade 300 from damaging a skateboard deck. However, in various embodiments, such a blade 300 may still include a flat body as depicted in FIGS. 3 and 4. As used herein, the body of a blade 300 may be referred to as "flat" if it has approximately the same thickness throughout, despite some variations, such as one area being sharpened to form an edge, a slightly rounded, wedge-shaped, or hourglass-shaped cross section, a pebbled surface, or the like.

In general, in various embodiments, the flat body of the blade 300 may be made of any material suitable for engaging with an ice surface, such as carbon steel, stainless steel, aluminum, or the like. For example, in one embodiment, the flat body of the blade 300 may be made of type-312 or type-304 stainless steel. In another embodiment, the flat body of the blade 300 may be made of type 7075 aluminum alloy. Due to the suitability of many metals, alloys, bimetals, and the like for engaging an ice surface, the flat body of the blade 300 may be a flat metal body in many embodiments. However, the description of various metals is not intended as limiting; other metals or non-metallic materials may be also be suitable for use in the flat body of a blade 300.

In one embodiment, each blade 300 includes an elongate sharp lower edge 304 and an opening 302 for pivotally mounting the blade on a skateboard axle end 108. In a further embodiment, as depicted in FIGS. 3 and 4, the flat metal body of the blade 300 includes both the elongate sharp lower edge 304 and the opening 302 for mounting the blade 300. In certain embodiments, an opening 302 for mounting the blade 300 may be disposed in a thickened metal portion of a blade 300 or in a blade housing that holds the flat metal body of a blade 300. Using a thickened metal portion or a blade housing may allow the blade 300 to be positioned along the axle end 108 without using spacer bushings 204, 206 as described above with regard to FIG. 2. However, in certain embodiments, disposing the opening 302 in the flat metal body of the blade 300 allows the blade 300 to be mounted directly to one of the axle ends 108 without a blade housing, so that spacer bushings 204, 206 and bearings can position the blade 300 along the axle end and allow the blade to pivot fluidly.

In one embodiment, the elongate sharp lower edge 304 of the blade 300 is configured to engage an ice surface for skating. In a certain embodiment, the edge 304 may be formed from a first bevel 306 on one side of the blade 300 and a second bevel 308 (visible in FIG. 4 but not in FIG. 3) on an opposite side of the blade 300, so that the edge 304 has a V-shaped cross section. A beveled blade 300, as in the depicted embodiment, differs from a traditional ice skate, in which each blade has two edges that engage the ice. Each bevel 306, 308 is characterized by a bevel angle, which is the angle, where the bevel 306, 308 meets the edge 304, between the surface of the bevel 306, 308 and an plane that extends vertically through the blade from the edge 304. Thus, the included angle for the edge 304 is the sum of the bevel angles. In one embodiment, the first bevel 306 and the second bevel 308 have equal bevel angles so that the edge 304 has a symmetrical, V-shaped cross-section. In another embodiment, however, the first bevel 306 and the second bevel 308 may have different bevel angles.

In a certain embodiment, a symmetrical, V-shaped cross section for the edge 304 may have an included angle of approximately 60 degrees. In another embodiment, a symmetrical, V-shaped cross section for the edge 304 may have an included angle of approximately 90 degrees. As used herein, the term "V-shaped" is intended to describe the general shape of the edge 304 without regard to its sharpness. Similarly, a "sharp edge," as described herein, refers to an edge 304 that can carve smoothly along an ice surface, without regard to whether the edge 304 would be described as sharp in other contexts. For example, in one embodiment, a very sharp edge 304 may carve smoothly along an ice surface, but may be quickly blunted by pressure. In another embodiment, a slightly blunter edge 304 may be less easily dulled, but may still be described as sharp based on its ability to carve smoothly along an ice surface. Thus, in a certain embodiment, the sharp portion of a beveled edge 304 where the bevels 206, 208 meet may not be perfectly angled, but may be slightly rounded or flattened. Nevertheless, such an edge 304 may also still be described as V-shaped. In a certain embodiment, the thickness of the slightly rounded or flattened portion of the edge 304 may be from 0.005 inches to 0.015 inches.

In one embodiment, the elongate sharp lower edge 304 of each of the four blades 300 for an ice skateboard or an ice skateboard conversion kit includes a symmetrical, V-shaped cross section. In another embodiment, however, some or all of the blades 300 may have edges with a different cross section. For example, in one embodiment, some of the blades 300 may have a flat or hollow ground bottom with two edges, similar to modern touring skates or figure skates.

In the depicted embodiment, the height-to-length ratio of the blade 300 is approximately 0.32. In a further embodiment, the length of a blade may be approximately 5 inches. In the depicted embodiment, the blade 300 includes convex front and back portions with a radius of curvature of approximately 0.313 inches (i.e., a diameter of approximately 0.626 inches), a convex top portion with a radius of curvature of approximately 0.812 inches, and concave slopes from the top portion to the front and back portions with a radius of curvature of approximately 4.500 inches. In another embodiment, however, the blade 300 may be shaped differently, or may include different radii of curvature.

In one embodiment, the opening 302 for mounting the blade 300 extends through a central portion of the blade 300. In the depicted embodiment, the opening 302 is circular. In one embodiment, the diameter of a circular opening 302 may match the diameter of a skateboard axle end 108, so that forces applied to the blade 300 are transferred directly to the axle end 108. However, in some embodiments, direct contact between the blade 300 and the axle end 108 may not allow the blade 300 to pivot smoothly. Therefore, in another embodiment, a larger opening 302, which may be circular or non-circular, may engage with a similarly shaped protrusion, lip, or blade engagement member on a spacer bushing 204, 206, as described below with regard to FIG. 5, so that forces applied to the blade 300 are transferred to the spacer bushing 204, 206 instead of directly to the axle end 108. In a further embodiment forces transferred to the spacer bushing 204, 206 may be transferred to the axle end via a bearing disposed in a recess 208 of the spacer bushing 204, 206, thus allowing the blade 300 to pivot more fluidly about the axle end 108.

In one embodiment, a circular opening 302 may engage a circular blade engagement member extending from a spacer bushing 204, 206, which allows the blade 300 to rotate about the axle end 108 independently of the spacer bushings 204, 206. In another embodiment, however, a non-circular opening 302, such as an opening 302 in the shape of a square with rounded corners, may engage a corresponding non-circular blade engagement member extending from a spacer bushing 204, 206, so that the blade 300 and the spacer bushing 204, 206 can co-rotate about the axle end 108.

In one embodiment, the center of gravity of the blade 300 may be positioned or disposed directly below the center of the opening 302 when the edge 304 is in a horizontal position, so that when the edge 304 is not engaging an ice surface (as when an aerial maneuver is performed), the blade 300 will fluidly pivot about the axle end 108 to maintain the edge 304 in a horizontal position. As ice is also often horizontal, maintaining the edge 304 in a horizontal position regardless of the angle of the skateboard helps the blade 300 to reengage the ice fluidly after a skateboarding trick is performed. In the depicted embodiment, the blade 300 is symmetrical, so that the center of the opening 302 and the center of gravity of the blade 300 are both disposed along the center line of the blade 300. In another embodiment, however, an asymmetrical blade 300 may be weighted to move the center of gravity under the center of the opening when the edge 304 is horizontal.

In the depicted embodiment, the edge 304 is flat. In another embodiment, however, the edge 304 of one or more blades 300 may include a toe portion and/or a heel portion that slope upward from a flat portion of the edge 304. In a further embodiment, the flat portion of the edge 304 would engage an ice surface during normal skating, and the upward slope of the heel portion and/or the toe portion would prevent the blade 300 from fouling on irregular surfaces.

Figure 5:
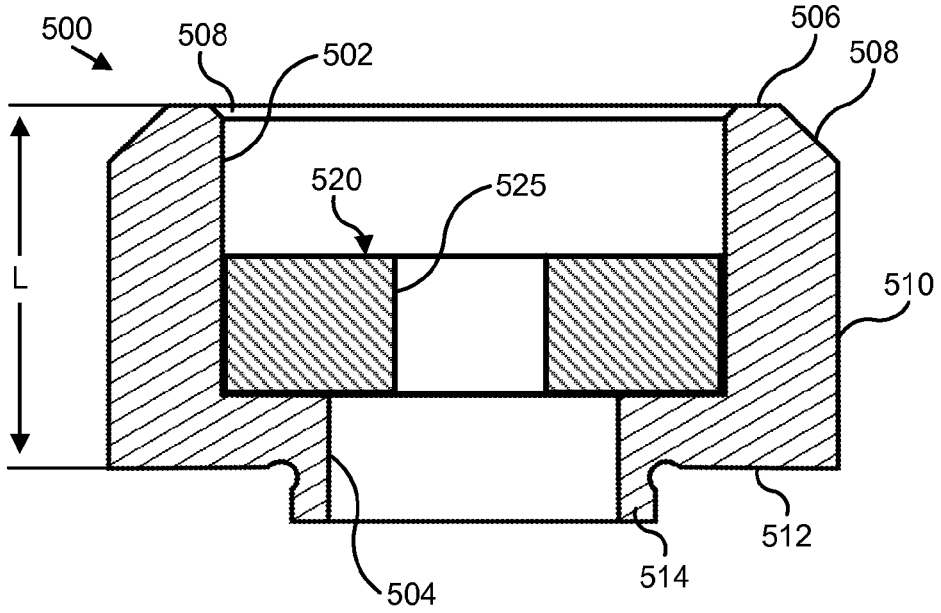
FIG. 5 is a cross-sectional view illustrating one embodiment of a spacer bushing.

FIG. 5 depicts one embodiment of a spacer bushing 500, which may be configured substantially as described above with regard to the spacer bushings 204, 206 of FIG. 2. FIG. 5 presents a cross-sectional view of the spacer bushing 500, from the location and in the direction indicated by the broken line in FIG. 2. In the depicted embodiment, the spacer bushing 500 includes a recess 502 for a bearing, which may be configured substantially as described above with regard to the recess 208 of FIG. 2.

In the depicted embodiment, the spacer bushing 500 is approximately cylindrical, with a curved outer surface 510, a proximal face 512, and a distal face 506. As used herein, "proximal" and "distal" refer to the intended position of each face with reference to a blade, so that when an ice skateboard conversion kit is mounted to an axle end, the proximal faces 512 of the spacer bushings 500 are closer to the blade than the distal faces 506. In various embodiments, as described above with regard to FIG. 2, the length L of each spacer bushing 500 (i.e., the distance between the proximal face 512 and the distal face 506) is selected to keep a blade in a desired position along an axle end.

In one embodiment, the spacer bushing 500 includes a bore 504 for pivotally mounting the spacer bushing 500 on one of the axle ends of the skateboard. In a further embodiment, the recess 502 may be configured to receive a bearing 520 so that a bore 525 for the bearing aligns with the bore 504 for the spacer bushing 500 for mounting the bearing and the spacer bushing 500 to the axle end. In a certain embodiment, the bore 525 for the bearing 520 may be sized to receive an axle end. In one embodiment, the central bore 504 for the spacer bushing 500 may be approximately the same size as the bore 525 for the bearing 520, so that the spacer bushing 500 and the bearing both engage the axle end directly. In another embodiment, however, the bore 504 for the spacer bushing 500 may be larger than the bore 525 for the bearing 525, so that only the bearing engages the axle end directly.

In the depicted embodiment, the spacer bushing 500 includes a protrusion, lip, or blade engagement member 514 extending from the proximal face 512. In one embodiment, the blade engagement member 514 may be shaped to engage the opening for at least one of the blades, as described above with regard to FIGS. 3 and 4. In a certain embodiment, the blade engagement member 514 and the opening in the blade may be circular, so that the spacer bushing 500 and the blade may rotate independently about an axle end. In another embodiment, the blade engagement member 514 and the opening in the blade may be formed as corresponding, non-circular shapes (e.g., a square with rounded corners), so that the spacer bushing 500 and the blade can co-rotate about an axle end.

In light of this disclosure, it is clear that various embodiments of spacer bushings 500 may engage the blades of an ice skateboard in multiple ways. In one embodiment, spacer bushings 500 with blade engagement members 514 that engage the blades may help provide stability by minimizing the slack between a blade and opposing spacer bushings, 500 after they are mounted to an axle end and the locking nut is tightened. In another embodiment, however, a spacer bushing 500 may not engage the opening in the central portion of a blade. For example, in one embodiment the spacer bushing 500 may include a flat proximal face 512 without a blade engagement member 514, and may pivot about an axle end without engaging the opening in the blade.

In one embodiment, the distal face 506 of the spacer bushing 500 may include chamfered edges 508. In a certain embodiment, chamfering the edge 508 between the distal face 506 and the curved outer surface 510 of the spacer bushing 500 may prevent the spacer bushing 500 from fouling on the skateboard deck during turning. In a further embodiment, chamfering the edge 508 between the distal face 506 of the spacer bushing 500 and the recess 502 for receiving a bearing may make it easier for a skater to insert a bearing into the recess 502.

Figure 6:
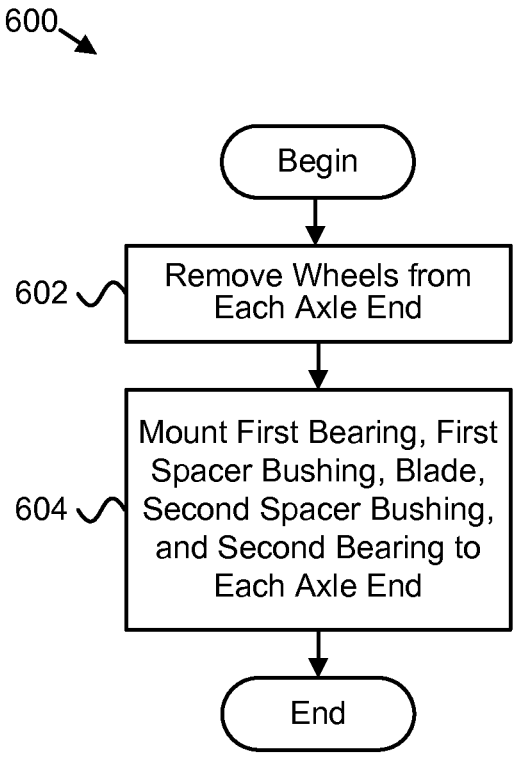
FIG. 6 is a schematic flow diagram illustrating one embodiment of a method for converting a skateboard to an ice skateboard.

FIG. 6 is a schematic flow diagram illustrating one embodiment of a method 600 for converting a skateboard to an ice skateboard. The method 600 begins, and a user removes 602 the wheels from each axle end of his or her skateboard. The user mounts 604 a first bearing, a first spacer bushing, a blade, a second spacer bushing, and a second bearing on each axle end so that the first bearing is disposed within the first spacer bushing, the second bearing is disposed within the second spacer bushing, and the blade is disposed between the first spacer bushing and the second spacer bushing, and the method 600 ends.

Although some of the embodiments of an ice skateboard conversion kit disclosed herein have been described as being operable with conventional skateboard trucks, it is recognized that the ice skateboard conversion kit embodiments of the present disclosure may also be operable in place of wheels in other contexts. For example, if an improved skateboard truck benefits the user of a wheeled skateboard, the same benefits may, in some cases, be obtained for the user of an ice skateboard by using an ice skateboard conversion kit with the improved skateboard truck.

Reference throughout this specification to "one embodiment," "an embodiment," or similar language means that a particular feature, structure, or characteristic described in connection with the embodiment is included in at least one embodiment of the subject matter of the present disclosure. Appearances of the phrases "in one embodiment," "in an embodiment," and similar language throughout this specification may, but do not necessarily, all refer to the same embodiment. Similarly, the use of the term "implementation" means an implementation having a particular feature, structure, or characteristic described in connection with one or more embodiments of the subject matter of the present disclosure, however, absent an express correlation to indicate otherwise, an implementation may be associated with one or more embodiments.

The schematic flow chart diagrams included herein are generally set forth as logical flow chart diagrams. As such, the depicted order and labeled steps are indicative of one embodiment of the presented method. Other steps and methods may be conceived that are equivalent in function, logic, or effect to one or more steps, or portions thereof, of the illustrated method. Additionally, the format and symbols employed are provided to explain the logical steps of the method and are understood not to limit the scope of the method. Although various arrow types and line types may be employed in the flow chart diagrams, they are understood not to limit the scope of the corresponding method. Indeed, some arrows or other connectors may be used to indicate only the logical flow of the method. For instance, an arrow may indicate a waiting or monitoring period of unspecified duration between enumerated steps of the depicted method. Additionally, the order in which a particular method occurs may or may not strictly adhere to the order of the corresponding steps shown.

Further, the terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise. Further, the term "plurality" can be defined as "at least two."

Additionally, instances in this specification where one element is "coupled" to another element can include direct and indirect coupling. Direct coupling can be defined as one element coupled to and in some contact with another element. Indirect coupling can be defined as coupling between two elements not in direct contact with each other, but having one or more additional elements between the coupled elements. Further, as used herein, securing one element to another element can include direct securing and indirect securing. Additionally, as used herein, "adjacent" does not necessarily denote contact. For example, one element can be adjacent another element without being in contact with that element.

As used herein, the phrase "at least one of", when used with a list of items, means different combinations of one or more of the listed items may be used and only one of the items in the list may be needed. The item may be a particular object, thing, or category. In other words, "at least one of" means any combination of items or number of items may be used from the list, but not all of the items in the list may be required. For example, "at least one of item A, item B, and item C" may mean item A; item A and item B; item B; item A, item B, and item C; or item B and item C. In some cases, "at least one of item A, item B, and item C" may mean, for example, without limitation, two of item A, one of item B, and ten of item C; four of item B and seven of item C; or some other suitable combination.

The present subject matter may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An ice skateboard conversion kit, comprising:

a blade comprising an elongate sharp lower edge and an opening for pivotally mounting the blade on a skateboard axle end; and two spacer bushings, each spacer bushing comprising a bore for pivotally mounting the spacer bushing on the axle end and a flat proximal face for laterally abutting the blade, wherein at least one of the two spacer bushings comprises a blade engagement member extending from the flat proximal face, the blade engagement member being shaped to extend into and support the opening of the blade, and wherein each spacer bushing comprises a recess configured to receive therein a bearing, the recess and bore of each spacer being open to each other;

wherein lengths of the spacer bushings are configured to dispose the blade along a predetermined portion of the axle end when the blade is pivotally mounted to the axle end between the two spacer bushings.

2. The ice skateboard conversion kit of claim 1, further comprising two bearings each positioned within the recess of a respective one of the spacer bushings, wherein each bearing comprises a bearing bore sized to receive the skateboard axle end, and wherein each recess receives a respective one of the bearings so that respective bores for the bearings align with the bores for the respective spacer bushings.

3. The ice skateboard conversion kit of claim 2, wherein the bore for the at least one spacer bushing is larger than the bore for the bearing.

4. The ice skateboard conversion kit of claim 1, wherein the blade engagement member and the opening are circular.

5. The ice skateboard conversion kit of claim 1, wherein the blade engagement member and the opening comprise corresponding, non-circular shapes.

6. The ice skateboard conversion kit of claim 1, wherein the blade comprises a flat metal body, the flat metal body comprising the elongate sharp lower edge and the opening for mounting the blade.

7. The ice skateboard conversion kit of claim 1, wherein the elongate sharp lower edge for the blade comprises a symmetrical, V-shaped cross-section.

8. The ice skateboard conversion kit of claim 7, wherein the symmetrical, V-shaped cross-section comprises an included angle of approximately 90 degrees.

9. The ice skateboard conversion kit of claim 1, wherein the blade comprises a height to length ratio of approximately 0.32.

10. The ice skateboard conversion kit of claim 1, wherein the blade comprises a length of approximately 5 inches.

11. The ice skateboard conversion kit of claim 1, wherein a center of gravity of the blade is disposed directly below a center of the opening for the blade when the elongate sharp lower edge for the blade is in a horizontal position.

12. The ice skateboard conversion kit of claim 1, wherein the elongate sharp lower edge for the blade comprises one or more of an upward-sloped toe portion or an upward-sloped heel portion.

13. An ice skateboard, comprising:

a skateboard deck;

a pair of skateboard trucks coupled to the skateboard deck, each truck comprising two axle ends;

four blades, each blade comprising a flat metal body, the flat metal body of each blade comprising an elongate sharp lower edge and an opening by which the blade is pivotally mounted to one of the axle ends, each elongate sharp lower edge comprising a symmetrical, V-shaped cross-section;

two spacer bushings on each axle end and abutting therebetween a respective one of the four blades, each spacer bushing comprising a bore for pivotally mounting the spacer bushing on the axle end and a proximal face for abutting the blade, wherein at least one of the two spacer bushings comprises a blade engagement member extending from the proximal face, the blade engagement member being shaped to extend into and support the opening of the blade, and wherein each spacer bushing comprises a recess configured to receive therein a bearing, the recess and bore of each spacer being open to each other; and a bearing positioned within each recess of the spacer bushings, each bearing comprising a bearing bore sized to receive an axle end.

14. The ice skateboard of claim 13, wherein at least one of the blades is positioned along a middle third of one of the axle ends.

15. The ice skateboard of claim 13, wherein at least one of the blades is mounted directly to one of the axle ends without a blade housing.

16. The ice skateboard of claim 13, wherein the symmetrical, V-shaped cross-section comprises an included angle of approximately 60 degrees.

17. The ice skateboard of claim 13, wherein at least one of the blades comprises a height to length ratio of approximately 0.32.

18. The ice skateboard of claim 13, wherein at least one of the blades comprises a length of approximately 5 inches.

19. A method of converting a skateboard to an ice skateboard, the skateboard having wheels mounted to axle ends, the method comprising:

removing the wheels from each axle end;

mounting, on each axle end, a first bearing, a first spacer bushing, a blade, a second spacer bushing, and a second bearing, the first bearing disposed within the first spacer bushing, the second bearing disposed within the second spacer bushing, and the blade disposed between the first spacer bushing and the second spacer bushing, wherein at least one of the first spacer bushing and second spacer bushing comprises a flat proximal surface that laterally abuts the blade and a blade engagement member that extends from the flat proximal surface of the at least one of the first spacer bushing;

extending the blade engagement member into a hole in the blade to support the blade on the blade engagement member; and extending each axle end through the first bearing and second bearing to support the first bearing and second bearing directly on the axle end, the first bearing and second bearing supporting the first spacer bushing and second spacer bushing indirectly on the axle end such that the first spacer bushing and second spacer bushing do not contact the axle end.

* * * * *